US005167490A

United States Patent [19]

McKee et al.

[11] Patent Number: 5,167,490

[45] Date of Patent: Dec. 1, 1992

[54] METHOD OF CALIBRATING A WELL PUMPOFF CONTROLLER

[75] Inventors: Fount E. McKee; Douglas M. Crume, both of Houston, Tex.

[73] Assignee: Delta X Corporation, Houston, Tex.

[21] Appl. No.: 859,747

[22] Filed: Mar. 30, 1992

[51] Int. Cl.[5] ..... F04B 49/02

[52] U.S. Cl. ..... 417/12; 417/18; 417/53; 73/151

[58] Field of Search ..... 73/151; 417/12, 18, 417/53

[56] References Cited

U.S. PATENT DOCUMENTS 4,286,925 9/1981 Standish ..... 417/12

4,583,915 4/1986 Montgomery et al. ..... 417/26

4,594,665 6/1986 Chandra et al. ..... 166/250

5,064,349 11/1991 Turner et al. ..... 417/20

*Primary Examiner*—Richard A. Bertsch

*Assistant Examiner*—David W. Scheuermann

*Attorney, Agent, or Firm*—Fulbright & Jaworski

[57] ABSTRACT

A method of calibrating a well pumpoff controller by calibrating the controller for determining the average load during a pumping stroke, measuring the actual load and averaging the measured maximum and minimum load during each operational stroke, comparing the average measured load with the calibrated average load and providing an offset to the load measurement to correct the measured load towards the calibrated load.

6 Claims, 4 Drawing Sheets

METHOD OF CALIBRATING A WELL PUMPOFF CONTROLLER

BACKGROUND OF THE INVENTION

The present invention is directed to a method of calibrating a well pumpoff controller using a non-calibrated load transducer producing a signal output which may drift with changes in temperature in which the pumpoff controller may be calibrated to offset the signal drift of the load cell.

It is well known as described in U.S. Pat. No. 4,286,295 to utilize a well pumpoff controller for pumping liquid from a well by measuring the load and position of a pump rod and pumping the well for a preset pump time. If the load on the down stroke is greater than the pumpoff control set point for a preselected number of consecutive strokes, the controller will shut the pump down for a predetermined downtime and thereafter restart the operation cycle.

Load cells of various types and designs have been in use in pumpoff controllers. Polished rod mounted type load transducers provide good accuracy and calibration. However, polished rod mounted load transducers are expensive and are subject to damage during operation. Beam mounted load transducers are simpler, less expensive, and have long operational life with low maintenance. However, such beam mounted transducers produce a relative signal output rather than a calibrated one and the output signal may drift with changes in ambient temperatures. That is, a beam mounted load cell is welded to the well walking beam during installation and typically has a non-zero output signal. Also, because of solar heating effects to the walking beam, the signal output of the tranducer drifts with temperature changes of the walking beam.

It is known as disclosed in U.S. Pat. No. 4,583,915 to adjust the minimum load measurement to overcome thermal drift. However, this correction does not provide the desired result under many well conditions.

The present invention is directed to a method of calibrating a pumpoff controller by using the average load for providing an offset signal to the load measurement for obtaining a near calibrated signal while using a simple, inexpensive non-calibrated load transducer.

SUMMARY OF THE INVENTION

The present invention is directed to a method of calibrating a well pumpoff controller for pumping liquid from a well by measuring the load and position of a pump rod and pumping the well for a preset minimum pump time. The well is shut down when the well pumps off and is left off for a preset downtime after which the well is restarted to repeat this cycle. The method includes calibrating the pumpoff controller with the average load during a typical pumping stroke, and then during each operational stroke measuring the load and position of the pump rod and averaging the measured maximum and minimum load measurements. Thereafter the measured averaged value of the load is compared with the calibrated average load and an offset signal is provided to correct the measured average load towards the calibrated average load.

A further object of the present invention is wherein the offset corrects the measured average load to be equal to the calibrated load during the minimum pump time.

Still a further object of the present invention wherein the correction of the offset is limited and the limited offset is used after the minimum pump time.

Other and further objects, features, and advantages will be apparent from the following description of a presently preferred embodiment of the invention, given for the purpose of disclosure, and taken in conjunction with the accompanying drawings.

DESCRIPTION OF THE PREFERRED EMBODIMENT

Figure 1:
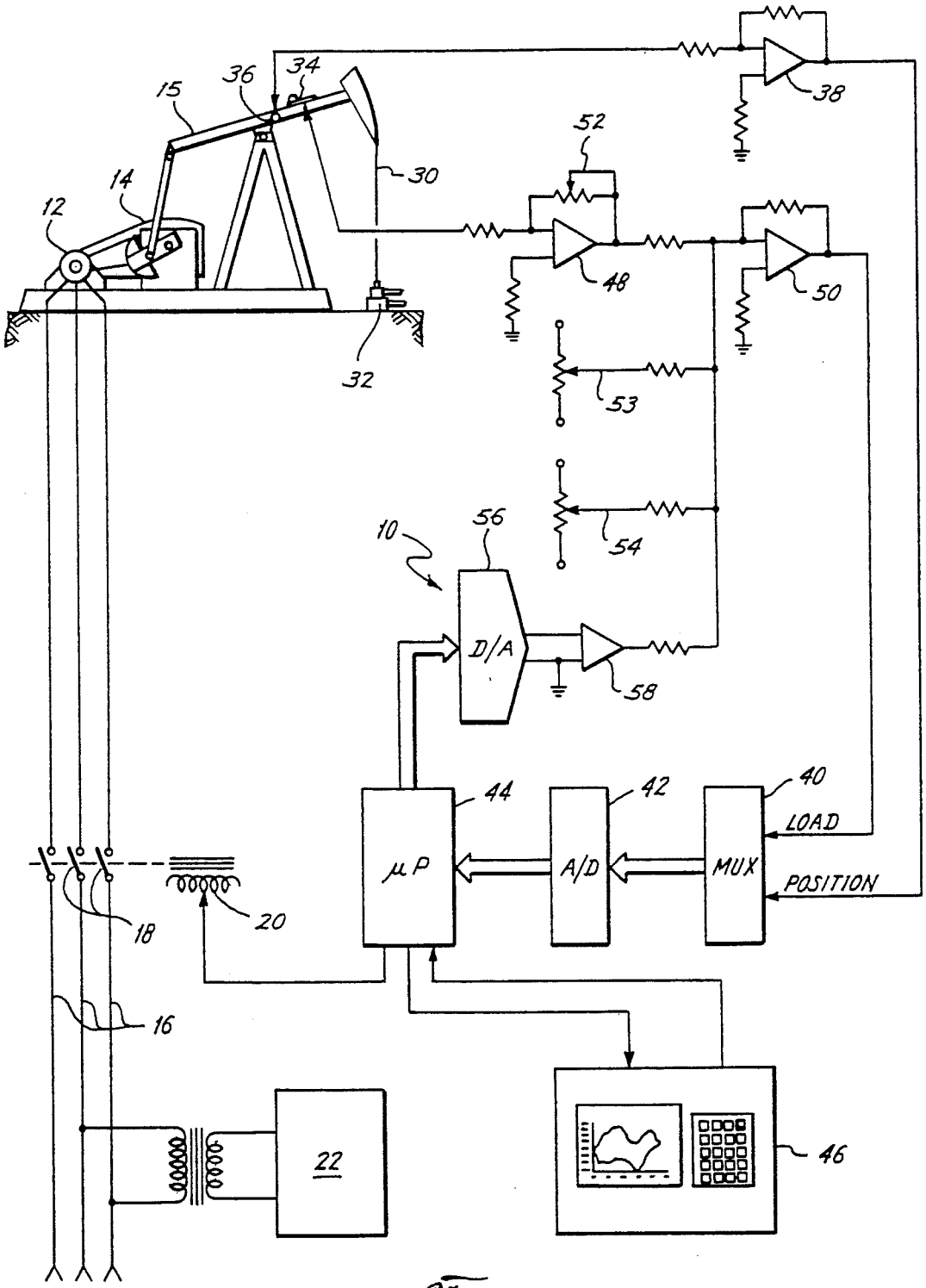
FIG. 1 is an electrical and mechanical schematic diagram of the present invention.

Referring now to the drawings, and particularly to FIG. 1, the reference 10 generally indicates the pumpoff control circuit of the present invention for controlling the electrical power to a drive motor 12 of a conventional oil well pumping unit 14. Electrical power supply lines 16 supply power through contacts 18 which are controlled by relay 20. The control circuit 10 operates relay 20 to open the contacts 18 and turn off the electrical power to the motor 12. A suitable power supply 22 provides DC power to the control circuit 10.

The motor 12 drives the conventional pumping unit 14 including a walking beam 15 which reciprocates a polished rod 30 upwardly and downwardly through a conventional wellhead 32 for actuating a well pump therebelow (not shown) as is conventional.

A load measuring means or transducer 34 which may be a welded beam transducer such as type 101TL sold by Delta-X Corporation provides a DC output signal which is proportional to the load on the polished rod 30. A suitable position measuring means or transducer 36 which may be any conventional transducer such as an analog position inclinometer transducer provides a DC output signal proportional to the angle of the walking beam 15 and thus of the vertical position of the polished rod 30.

The position signal from the position transducer 36 passes through amplifier 38, through an analog multiplexer 40, through an analog to digital converter 42 and then to a control microprocessor 44 such as the System 60 of Delta-X Corporation. Also, an interface to the user may be provided to set operation parameters and retrieve data, such as a keyboard and graphics display 46.

The load signal from the load transducer 34 passes through a first amplifier 48 and a second amplifier 50. The amplifier 48 for the load signal has a manual control 52 for adjusting the signal gain. The amplifier 50 has manual controls 53 and 54 for fine and course adjustment, respectively, for providing signal offsets to the amplifier 50. Furthermore, the microprocessor 44 controls a digital to analog converter 56 which supplies an analog signal to amplifier 58 for providing a load signal offset. The gain and offset controls 52, 53, 54 and 56 are used in the calibration and correction of the load signal from the load transducer 34. Thus, the load transducer 34 may be of a type which produces a relative signal output rather than a calibrated one and may drift with changes in temperature. That is, because of the solar heating effects to the walking beam 15, the signal output from the load transducer 34 may drift with temperature changes of the walking beam 15. As will be described hereinafter the improved control circuit 10 provides a method of obtaining near calibrated data with the less expensive simpler and highly reliable transducer 34.

As described in U.S. Pat. No. 4,286,925 in order to perform pumpoff operations the controller 10 is initially provided with certain setup parameters. One parameter is a pumpoff control set point 60 (FIG. 3) which is represented by a unique load and position in the dynamometer card plot 62 (FIG. 3) set by the user. That is, during pumpoff well conditions, the measured load in the down stroke will be greater than the set point load 60. However, during conditions when the well is filling normally the measured load in the down stroke should be less than the set point load 60.

With the nature of some wells, the amount of pump fillage will vary from one down stroke to the next down stroke. This may be only a transient occurrence and not a complete indication of pumpoff (which is noted as a general movement of a portion 62 (FIG. 3) of the downstroke curve left during consecutive down strokes). This could result in false detection of pumpoff as the curve 62 crosses the set point 60 due to one stroke producing a sudden movement to the left, but returning to the right of the set point 60 in the next stroke. To insure reliable pumpoff detection, another parameter specifies a required number of consecutive strokes of set point 60 crossings to indicate when the well is pumped off.

If the well is pumped off the microprocessor 44 will stop the pumping unit motor 12 from running through actuation of the relay 20. The pump unit 14 will be kept off for a preset amount of time to allow the well to again fill with fluid. This amount of time is another user specified set up parameter referred to as "down time" as more fully discussed in U.S. Pat. No. 5,064,348.

After the down time is complete, the microprocessor 44 will start the pumping unit motor 12. The pumping unit 14 will be kept on for a preset amount of time regardless of pumpoff conditions, after which normal pumpoff testing will be resumed. This is done to allow pump fillage conditions to stabilize for wells that require it. This amount of time is another user specified setup parameter referred to as "minimum pump time".

Therefore normal operation of the circuit, as is conventional, is to operate the pump for a period of "minimum pump time", then continue running until the pumped off well condition is detected, after which the pump is turned off for a "preset downtime."

Initial setup and calibration of the circuit 10 is required. External equipment such as XY plotter, for example a DXD-03 plotter sold by Delta-X may be connected to the outputs of the load and position signals to provide a quantitative dynagraph 64 (FIG. 2) from which the peak polished rod load (PPRL) and minimum polished rod load (MPRL) are measured. These two readings are entered into the control circuit 10 as the calibration parameters. Now the pumping unit 14 is run as a plot 64 is produced on the display 46. This plot consists of load plotted on the vertical axis and position on the horizontal axis. The scale of the load axis may extend, for example, from 0 pounds at the bottom to 45,000 pounds at the top. The scale of the position axis extends from 0 inches, for example, at the left to the pumping unit stroke length, for example, 100 inches, at the right. Imposed on this plot are two horizontal-lines 66 and 68 corresponding to the PPRL and MPRL readings, respectively. The graph 64 being plotted will not be calibrated as of yet and may produce plots with the load too high or too low, or clipped to the top or bottom, even to the point that the plots are flat lines due to the load amplifier saturating at either extreme of this operational range.

Figure 3:
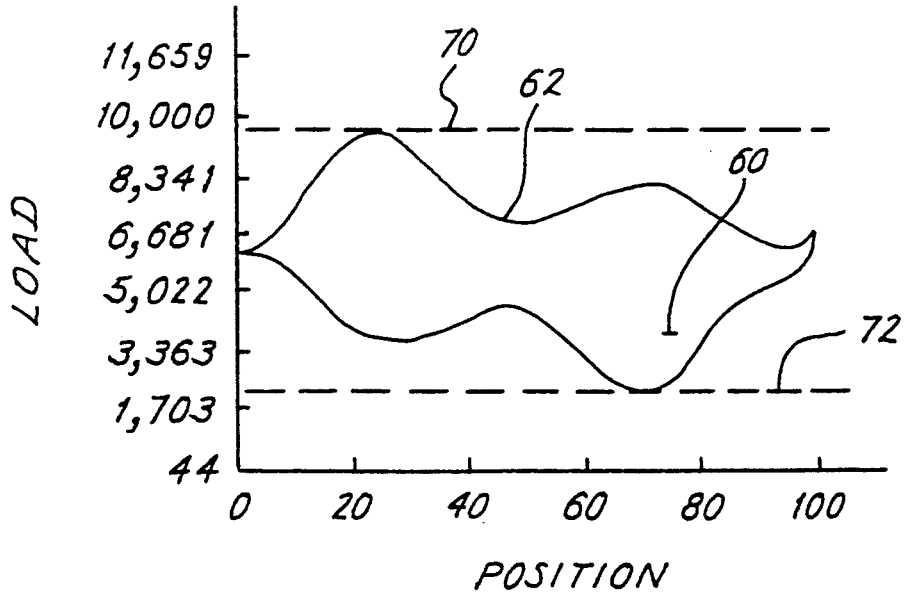

At this point, the user must adjust the manual controls 52, 53 and 54 (FIG. 1) for load offset and gain until the plots are within the two-lines 70 and 72 (FIG. 3) representing the PPRL and MPRL. The highest point of the plot must just reach the PPRL line 70 while the lowest point of the plot must just reach the MPRL line 72 in order to allow a precise calibration of the system. The plot may be rescaled, as best seen in FIG. 3, in the load axis for greater resolution. With the calibration complete, the average value of the setup parameters PPRL and MPRL becomes the average calibrated load. This average calibrated load is what will be used in the operational step to determine if the load cell 34 output signal has drifted due to a change in the ambient temperature and to compensate for and offset for the signal drift.

Figure 2:
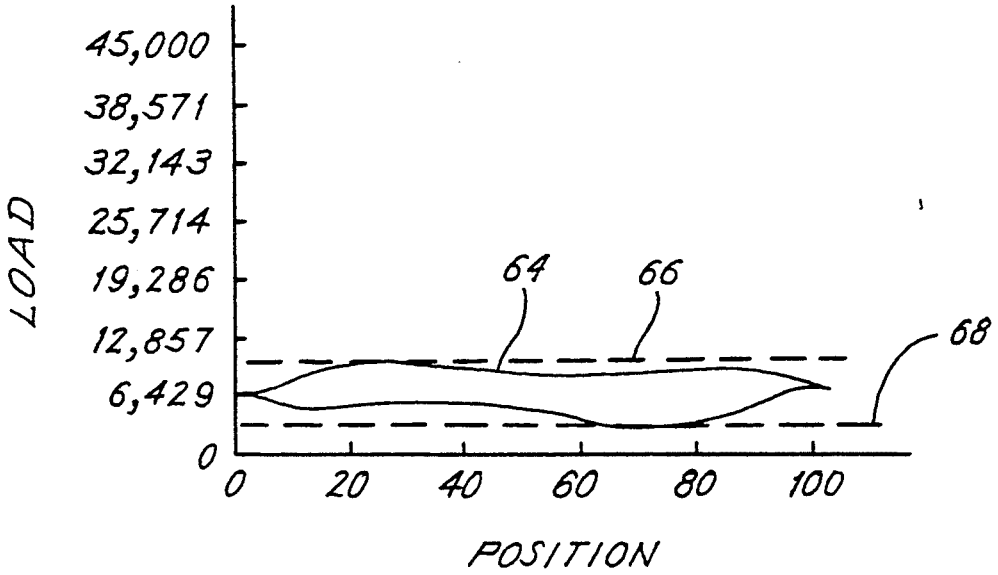
FIG. 2 and FIG. 3 are graphs of load versus position measurements with FIG. 2 being a non-calibrated graph and FIG. 3 showing a graph which is adjusted for load gain and offset.
Figure 4:
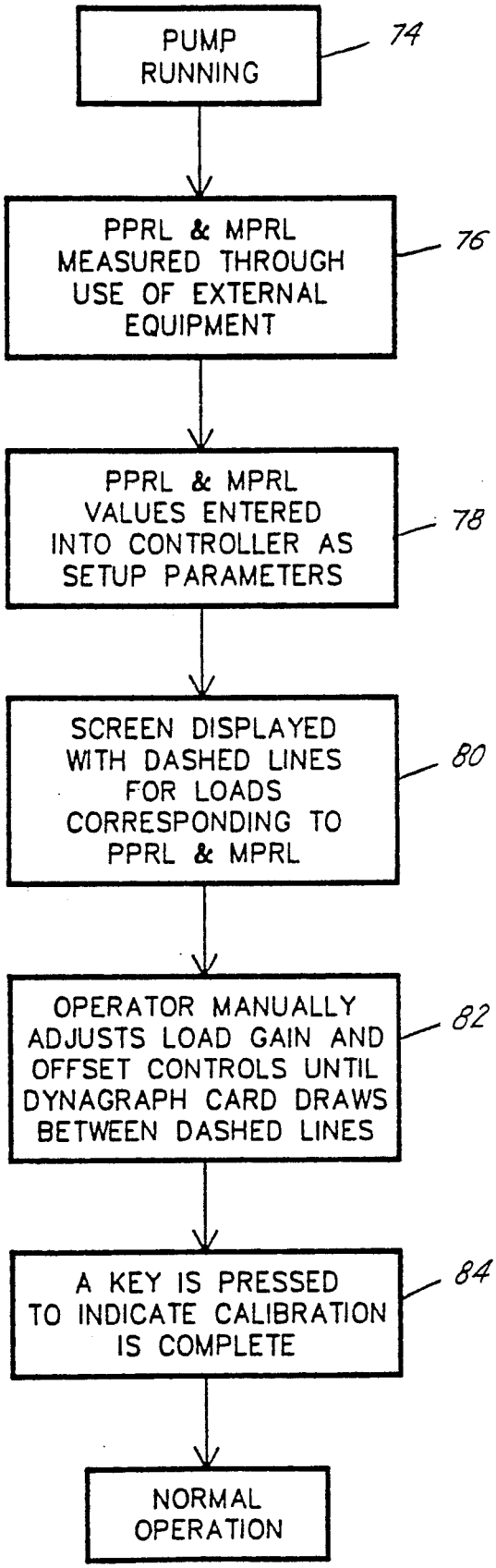
FIG. 4 is a logic flow chart of the load calibration for determining the average load during a pumping stroke.

Referring now to FIG. 4, the logic flow diagram for performing the load calibration steps discussed with reference to FIGS. 2 and 3 is best seen. In step 74 the system 10 is actuated to cause the pumping unit 14 to run. In step 76 through the use of an external equipment such as a plotter the peak polished rod load (PPRL) and the minimum polished rod load (MRPL) are measured and entered into the display 46 as set up parameters in step 78.

In step 80 the screen in the display 46 displays the dashed lines 70 and 72 corresponding to the PPRL and MPRL rod loads. In step 82 the operator manually adjusts the load gain 52 and the offset gains 53 and 54 until the graph 62 is drawn between the dashed line 70 and 72. In step 84 the key is pressed to indicate the calibration is complete.

It is to be noted during this calibration procedure that the offset produced by the digital to analog converter 56 is digitally set to one-half of its range and remains constant. This is done so that once calibration is complete, the microprocessor 44 will be able to vary the offset both up and down in order to correct any drift from the load transducer 34. With the manual calibration completed, the produced plot 62 represents a quantitative dynagraph card.

Calibration and set up procedures are now completed and the controller 10 may begin normal pumpoff operations. With each stroke of the pumping unit 14 measurements of the load and position by the transducers 34 and 36, respectively, are transmitted to the micro processor 44.

Normal operation for the controller 10, as has been previously described, is to operate the pump 14 for a period of "minimum pump time", then continue running until a pumpoff well condition is detected, after which the pump is turned off for a downtime. The present method corrects for any load cell drift and such corrections are made for each stroke while the pump 14 is running. That is, during each operational stroke the load and position of the pump rod is measured and the measured maximum and minimum load measurements are averaged. Then the average measured value of the load is compared with the calibrated average load by the microprocessor 44 and it provides an offset to the digital to analog converter 56 to provide an offset to the load amplifier 50 to correct the actual measured average loads towards the calibrated average load.

However, one problem that may occur is for the load cell output signal to drift while the pumping unit is in "downtime". Since no pumping unit strokes are occurring at this time, no drift corrections are being made. If the downtime is adequately long, substantial drift may accumulate before the pumping unit 14 completes downtime and begins operation again. This is effectively handled in the controller by allowing a large step of the digital to analog converter 56 to correct all of the measured drift each stroke of the pumping unit during "minimum pump time". At this time the correction is to provide the proper amount of offset to bring the average of the measured peak and minimum load values to the average of the calibrated setup parameters PPRL and MPRL.

That is, each stroke during the "minimum pump time" the maximum and minimum measured load values are averaged together, and the resulting load is compared to the average of the set up parameters PPRL and MPRL. The microprocessor 44 will change the digital analog converter 56 offset to the load amplifier 50 to compensate for the drift. That is, the offset to correct the measured average load is whatever amount is needed to make the measured average load equal to the calibrated average load during the "minimum pump time".

However, after the "minimum pump time" has elapsed, the amount of the offset correction of each stroke is limited to only a partial correction of the drift rather than a complete or large step correction. This limited amount of correction after the elapse of "minimum pump time" is to avoid an error occurring in the correction procedures in the event that the pump is subject to being pumped off. The full correction can be made during the "minimum pump time" as it is more unlikely that any pumpoff will occur during this period of time.

Figure 5:
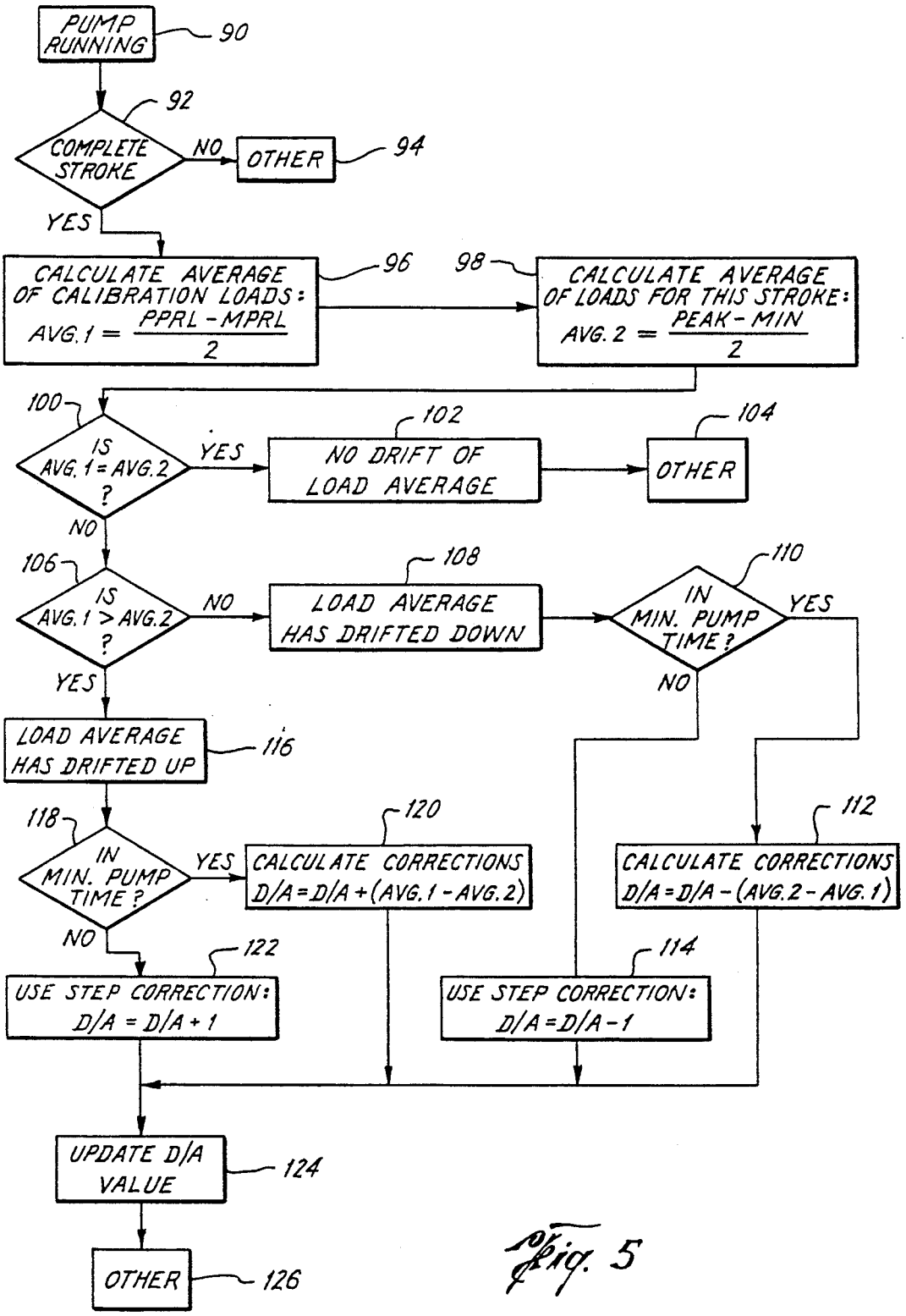
FIG. 5 is a logic flow chart illustrating the normal operation of the pumpoff controller for providing a corrected load output signal.

Referring now to FIG. 5, the logic flow diagram for performing the operational offset corrections to the measured load as has been described, is more fully shown. In step 90 the pump is running in its operational mode and step 92 indicates if it completes a stroke. If not, other operations are performed in step 94. However, if a complete stroke is obtained the average of the calibration loads is obtained from the load calibration of FIG. 4 and the average calibration load of AVG1 is obtained. In step 98 the average of the loads for the complete stroke of step 92 is measured to be the average of the peak and minimum polished rod loads and is here designated as AVG2.

In step 100 AVG1 is compared with AVG2. If the measured average load is equal to the calibrated average load, step 102 indicates that no drift has occurred and step 104 performs other operational steps. If the answer to step 100 is NO, step 106 inquires if AVG1 is greater than AVG2. If the answer is NO, then step 108 indicates that the measured average load has drifted down and step 110 determines whether this occurred in minimum pump time. If the answer is YES, the full correction is made in step 112 to provide an offset correction signal to correct the measured average load equal to the calibrated average load. On the other hand, if the drift downwardly occurred after the minimum pump time, step 114 only makes a small step correction. The corrections from steps 112 and 114 are transmitted to step 124 to update the digital to analog offset correction value.

If the answer to step 106 was YES, step 116 indicates that the measured average load has drifted up and step 118 determines whether this has occured in minimum pump time. If the answer in step 118 is YES, then the full correction is calculated in step 120 to provide an offset correction signal of the measured average load to the calibrated average load and this is transmitted to the update in step 124. However, if the answer to step 118 is NO, a small step correction is used in step 122 which is thereafter sent to update step 124. After the offset is updated in step 124, the offset adjustment flow diagram of FIG. 5 is exited through step 126.

What is claimed is:

1. A method of calibrating a well pumpoff controller for pumping liquid from a well by measuring the load and position of a pump rod and pumping the well for a preset pump time, shutting down the well when the well pumps off, and thereafter restarting the operation for a preset downtime comprising, calibrating the pumpoff controller for determining the average load during a pumping stroke, during each operational stroke measuring the load and position of the pump rod, and averaging the measured maximum and minimum load measurements, and comparing the measured averaged value of load with the calibrated average load and provide an offset to the load measurement to correct the measured load towards the calibrated load.

2. The method of claim 1 wherein, the offset corrects the measured average load to be equal to the calibrated average load during the minimum pump time, and a limited offset is used after the minimum pump time.

3. The method of claim 1 wherein the offset corrects the measured load to be equal to the calibrated load.

4. The method of claim 3 wherein the offset to correct the measured load equal to the calibrated load is performed during the minimum pump time.

5. The method of claim 1 wherein the amount of the offset is limited.

6. The method of claim 5 the limited offset is used after the minimum pump time.

* * * * *